US005992109A

United States Patent [19]

Jonker

[11] Patent Number: 5,992,109

[45] Date of Patent: Nov. 30, 1999

[54] FLOOR-TO-CEILING DEMOUNTABLE WALL

[75] Inventor: Kurt A. Jonker, Grand Rapids, Mich.

[73] Assignee: Steelcase Development, Inc., Grand Rapids, Mich.

[21] Appl. No.: 08/843,231

[22] Filed: Apr. 14, 1997

[51] Int. Cl.[6] ..... E04H 1/00; E04B 2/14

[52] U.S. Cl. ..... 52/238.1; 52/243.1; 52/241; 52/126.4; 52/586.1; 52/588.1; 52/508

[58] Field of Search ..... 52/238.1, 239, 52/243.1, 242, 287.1, 235, 126.4, 241, 586.1, 587.1, 588.1, 584.1, 506.06, 508, 512

[56] References Cited

U.S. PATENT DOCUMENTS

| | | | |
|---|---|---|---|
| 1,580,107 | 4/1926 | Anderson . | |
| 2,766,855 | 10/1956 | Johnson et al. . | |
| 3,020,988 | 2/1962 | Bransford, Jr. | 52/512 |
| 3,173,176 | 3/1965 | Kumburis | 52/508 |
| 3,180,459 | 4/1965 | Liskey, Jr. . | |
| 3,195,698 | 7/1965 | Codrea . | |
| 3,462,904 | 8/1969 | Napier | 52/242 |
| 3,733,755 | 5/1973 | Butler . | |
| 3,745,732 | 7/1973 | Pritchard et al. . | |
| 3,998,018 | 12/1976 | Hodges . | |
| 4,020,611 | 5/1977 | Amos | 52/586.1 |
| 4,060,951 | 12/1977 | Gere | 52/508 |
| 4,067,165 | 1/1978 | Timmons | 52/238.1 X |
| 4,186,534 | 2/1980 | Le Coze . | |
| 4,349,995 | 9/1982 | Dowler et al. . | |
| 4,535,577 | 8/1985 | Tenser et al. | 52/238.1 X |
| 4,538,390 | 9/1985 | Yeager et al. . | |
| 4,621,467 | 11/1986 | Golden | 52/586.1 X |
| 4,635,418 | 1/1987 | Hobgood . | |
| 4,667,450 | 5/1987 | Stefnik et al. . | |
| 4,682,457 | 7/1987 | Spencer . | |
| 4,709,517 | 12/1987 | Mitchell et al. . | |
| 4,757,657 | 7/1988 | Mitchell et al. . | |
| 4,833,848 | 5/1989 | Guerin | 52/242 |
| 4,905,428 | 3/1990 | Sykes . | |
| 4,956,957 | 9/1990 | Vandini | 52/582.1 |
| 5,067,543 | 11/1991 | Bove . | |
| 5,134,826 | 8/1992 | La Roche et al. . | |
| 5,155,955 | 10/1992 | Ball et al. . | |
| 5,209,035 | 5/1993 | Hodges et al. . | |
| 5,377,466 | 1/1995 | Insalaco et al. . | |
| 5,544,461 | 8/1996 | Sommerstein | 52/235 |
| 5,586,593 | 12/1996 | Schwartz . | |
| 5,701,708 | 12/1997 | Taraba et al. | 52/586.1 X |

FOREIGN PATENT DOCUMENTS

| | | |
|---|---|---|
| 129841 | 11/1948 | Australia . |
| 714002 | 8/1954 | United Kingdom . |

*Primary Examiner*—Beth A. Aubrey
*Assistant Examiner*—Brian E. Glessner
*Attorney, Agent, or Firm*—Price, Heneveld, Cooper, DeWitt & Litton

[57] ABSTRACT

A demountable floor-to-ceiling wall for subdividing a building work space comprises a first core panel including two parallel spaced-apart and substantially identical side faces in mutual horizontal registry. Each core panel has a panel periphery with a top edge, a bottom edge, and at least two side edges and an outwardly facing channel therein. A first core panel is vertically oriented and positioned to be supported by the building floor. A second core panel of substantially identical construction as the first core panel is vertically stacked upon and substantially co-planar with the first core panel. The first and second core panels extend from the floor toward the ceiling and are secured in a generally upright vertical orientation. A panel connector bar is interposed between the first and second core panels. A first portion of the panel connector bar is received by and engaged within the channel at a top portion of the first core panel, and a second portion of the panel connector bar is received by and engaged within the channel at a bottom portion of the second core panel. The panel connector bar maintaining the core panels in a substantially co-planar relationship in a fastenerless fashion.

42 Claims, 5 Drawing Sheets

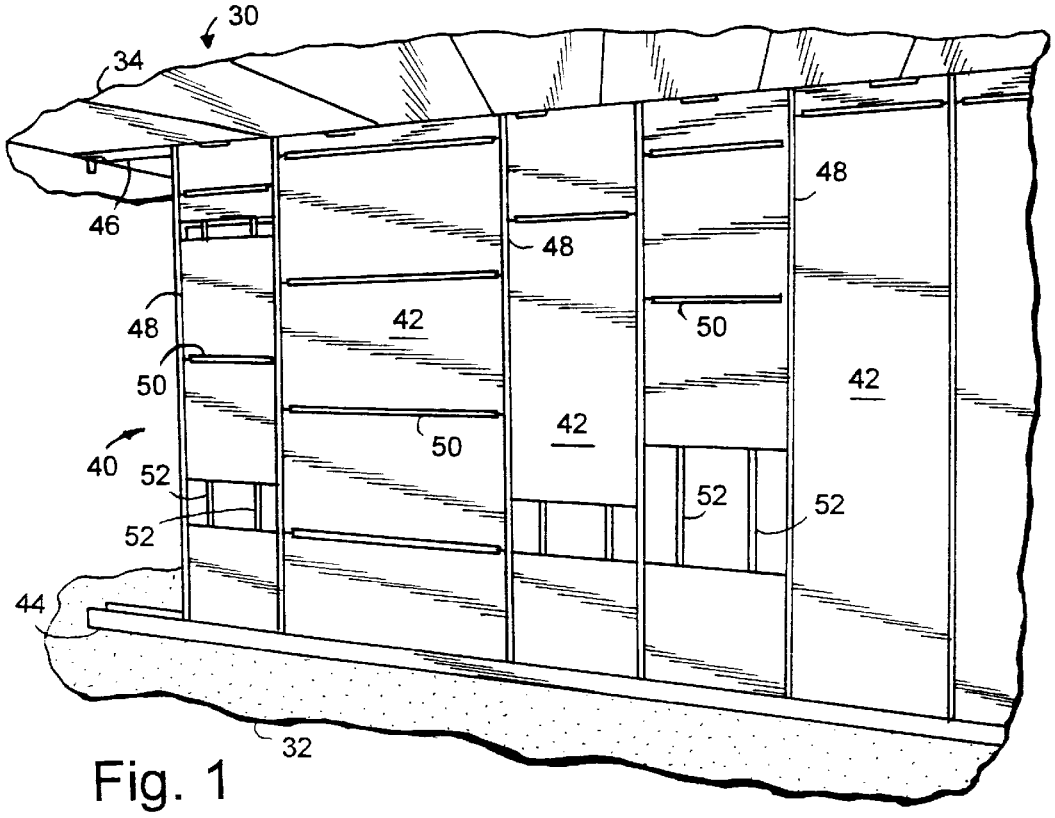
Fig. 1
Fig. 2
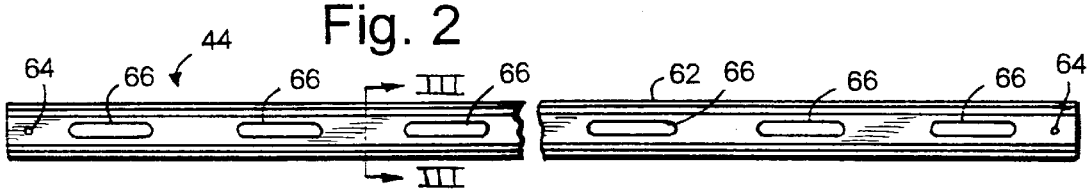
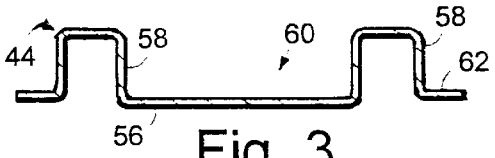
Fig. 3
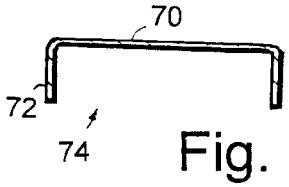
Fig. 5
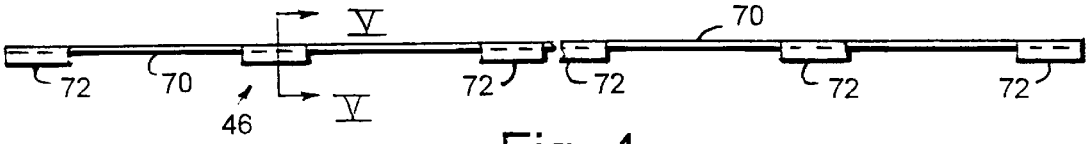
Fig. 4

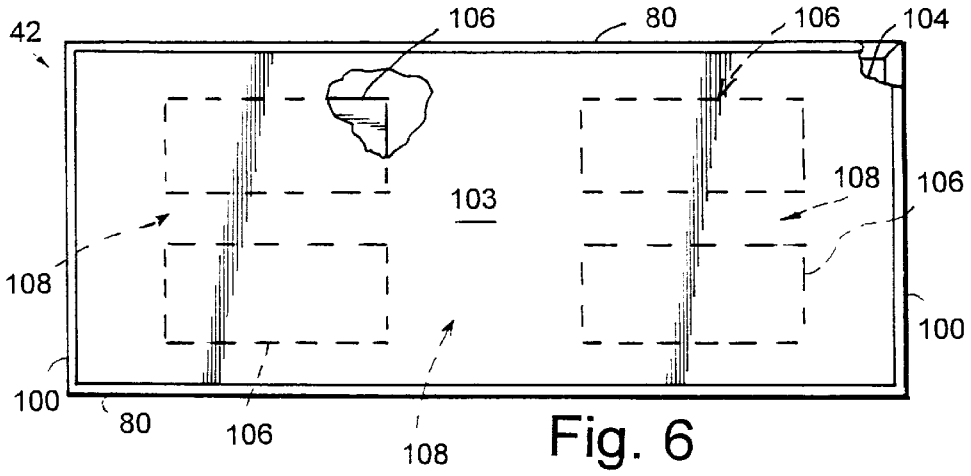
Fig. 6
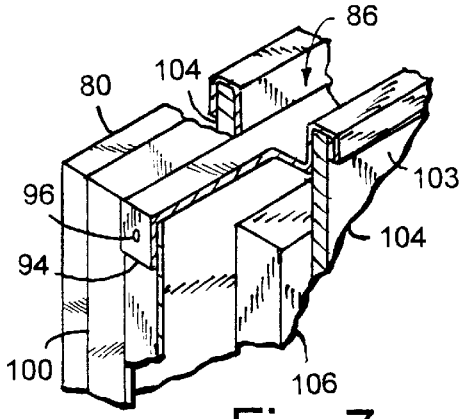
Fig. 7
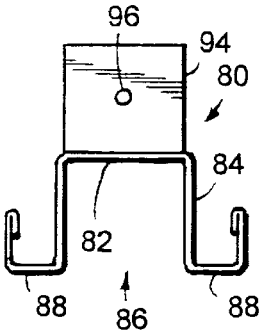
Fig. 9
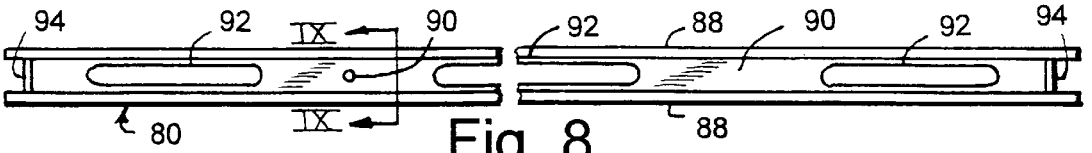
Fig. 8
Fig. 10
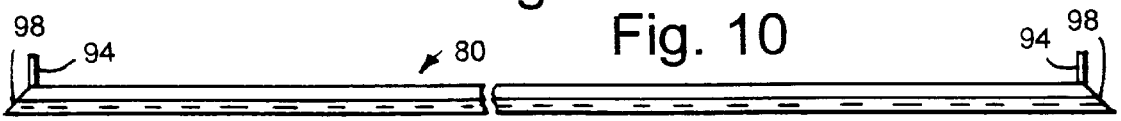
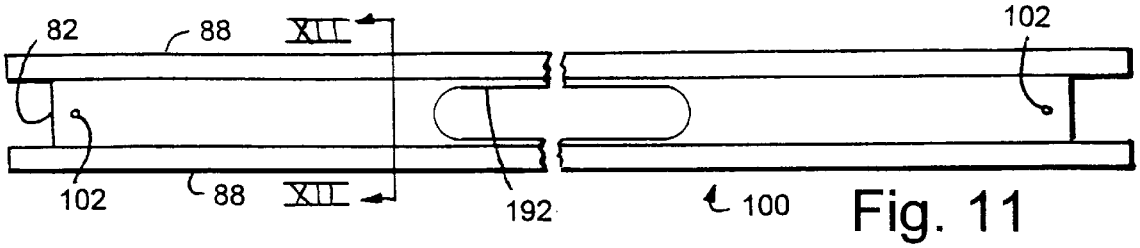
Fig. 11

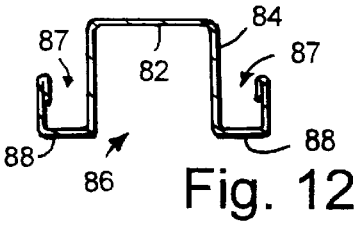
Fig. 12
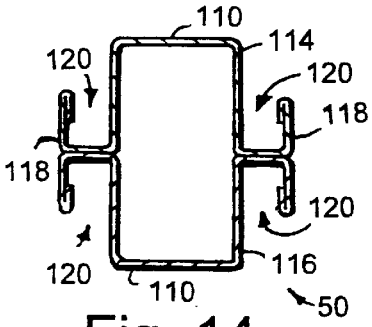
Fig. 14
Fig. 13
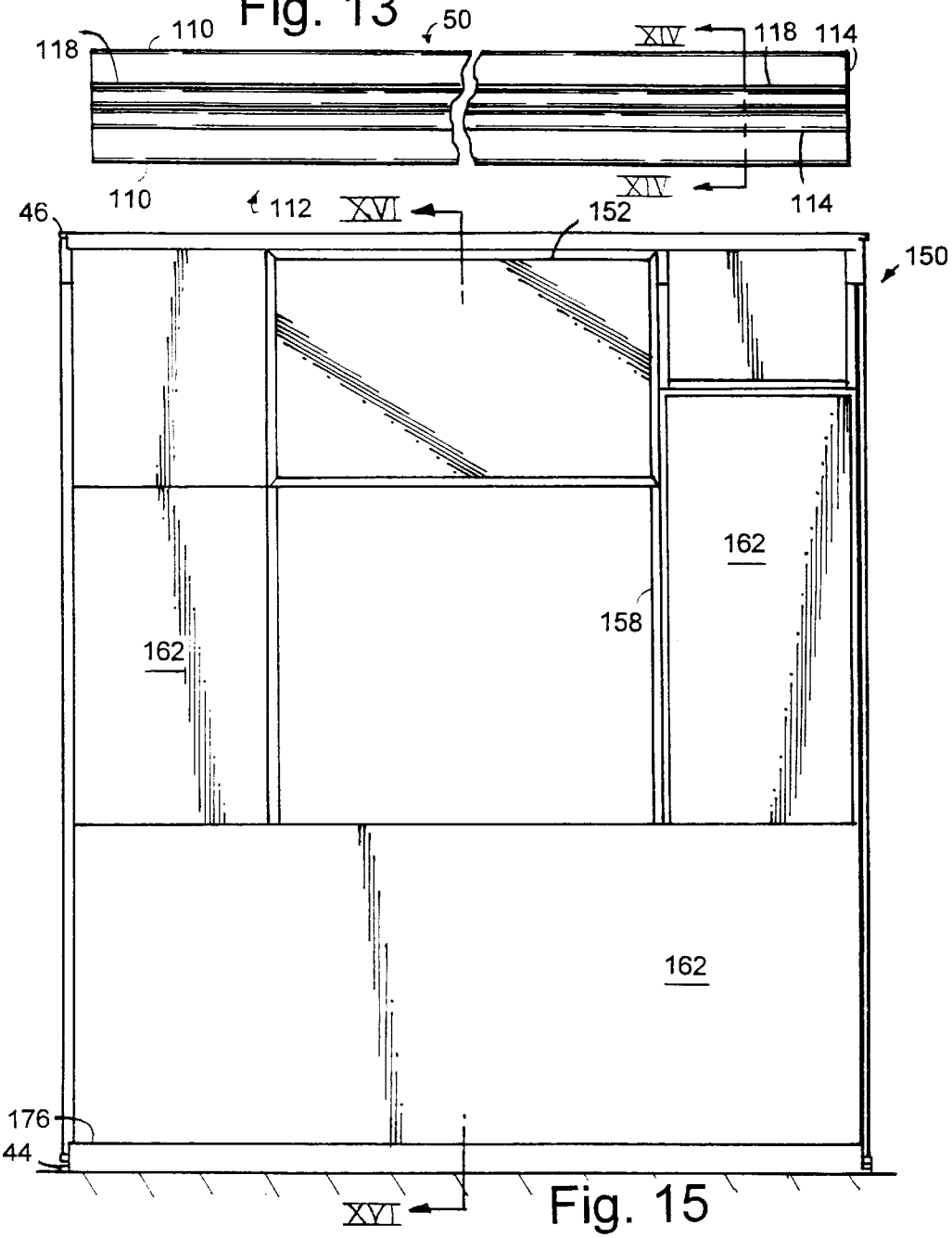
Fig. 15

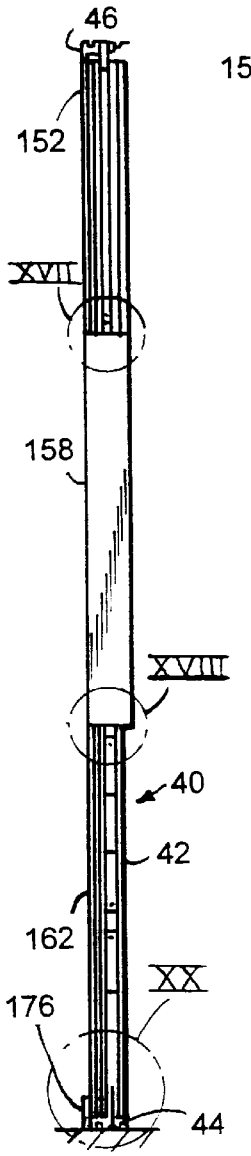
Fig. 16
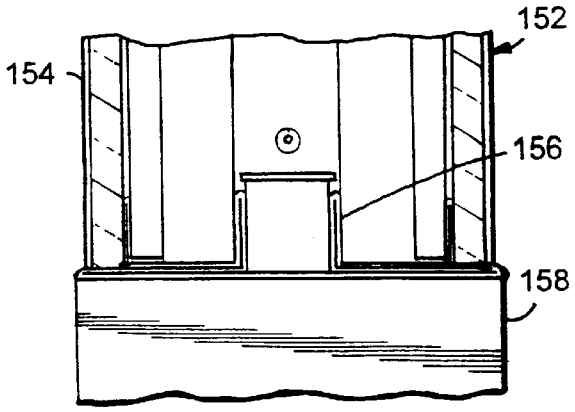
Fig. 17
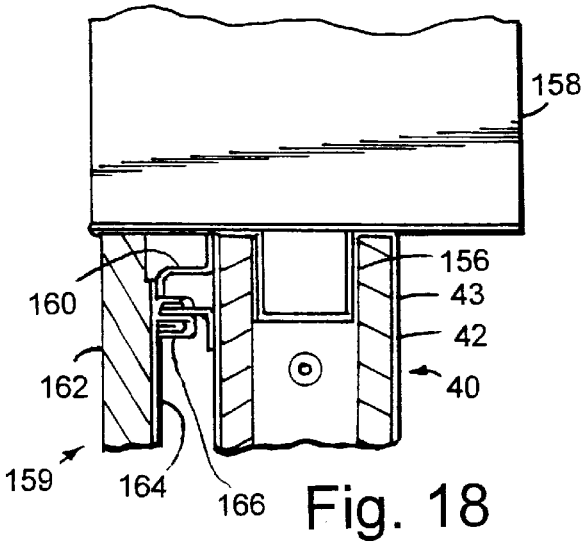
Fig. 18
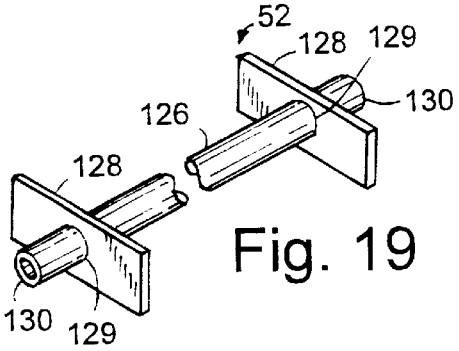
Fig. 19
Fig. 20
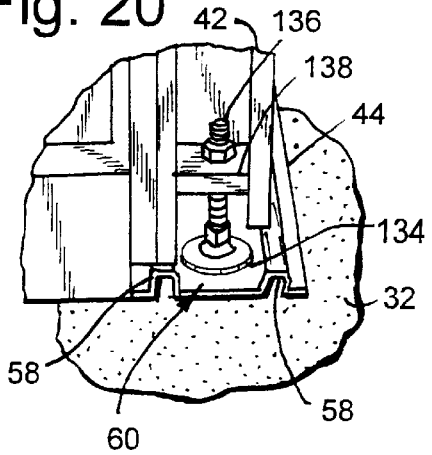

FLOOR-TO-CEILING DEMOUNTABLE WALL

BACKGROUND OF THE INVENTION

The present invention relates to demountable walls for open office spaces and the like, and particular, to a floor-to-ceiling demountable wall system and related wall panels. Demountable wall systems for open office spaces, and other similar settings, are well known in the art. Individual wall panels are interconnected in different configurations to form walls extending from floor to ceiling for the creation of separate offices, work areas, or passageways. Partition panels are extremely durable, and can be readily disassembled and reassembled into alternative configurations to meet the ever-changing needs of the user.

The finishing or fitting-out of building spaces for offices, medical treatment facilities, and other similar environments has become a very important aspect of the effective space planning and layout. Work patterns, technology, and business organizations are constantly evolving and changing. The users of building space require products which facilitate change at lower costs. Space planning is no longer a static problem. Changing technology and changing work processes demand that a design and installation be able to support and anticipate change.

There is presently an over supply of office space and furniture systems which do not properly respond to or support change. Many older buildings do not have adequate utility capabilities, and the cost of conventional renovations or improvements often renders the same impractical. Even relatively new buildings can be quickly rendered obsolete by the fast paced changes in modern technology.

Consequently, fully integrated prefabricated furnishing systems have been developed to finish or fit-out both new and existing open plan building spaces. One requirement of this integrated furnishing system is a demountable floor-to-ceiling wall system having the capability for easy and rapid division of large work areas into smaller work areas, private offices, or a combination thereof. These individual work areas are in turn interconnected by passageways of various configurations as dictated by the particular work dynamics of the individual work areas. The work areas may be further divided into work stations using other well known modular office systems.

Another desired aspect of the present integrated furnishing system is to provide a demountable wall having increased flexibility for forming floor-to-ceiling walls which are assembled with a variety of preformed panels for multiple wall configurations and an interconnecting system which provides a stable wall while requires minimal use of labor intensive fasteners. For example, a demountable wall system is desired that only requires use of fasteners to affix the wall to the existing building architecture and the remainder of the wall system is constructed in building block style even where the dimensions of the office layouts are not dimensioned in multiples of standard construction materials. Additional functionality of the wall system is also desired, such as to permit the inclusion of doors or windows in desired locations without a requirement to modify the sizes and proportions of the individual panels comprising the wall. Further, the wall should provide acoustic isolation from adjacent work areas as well as providing a fire block between work areas.

Portions of such a demountable office wall system should also be relatively thin and adaptable to receive a variety of external panels to provide additional acoustic and fire protection, the routing of office utilities to individual users within the office environment, and aesthetically balance the demountable wall with the decor of other portions of the work areas without resulting in a wall of excessive thickness rendering valuable floor space useless. Thus, a relatively thin demountable wall system is desired which also possesses the modular characteristics similar to the modular characteristics of the office dividing system utilized within the work area.

Thus, a wall construction solving the aforementioned problems and providing the aforementioned functionality is desired.

SUMMARY OF THE INVENTION

One aspect of the present invention is an improvement to a demountable floor-to-ceiling wall for subdividing building work space of the type having a floor and a ceiling. The improvement to the demountable wall comprises a first core panel including two parallel spaced-apart and substantially identical side faces in mutual horizontal registry. A panel periphery comprises a top edge, a bottom edge, and at least two side edges, with an outwardly facing channel therein. The first core panel is vertically oriented and positioned to be supported by the building floor. A second core panel of substantially identical construction as the first core panel is vertically stacked upon and substantially co-planar with the first core panel. The first and second core panels extend from the floor toward the ceiling and are secured in a generally upright vertical orientation. A panel connector bar is interposed between the first and second core panels. A first portion of the panel connector bar is received by and engaged within the channel at a top portion of the first core panel, and a second portion of the panel connector bar is received by and engaged within the channel at a bottom portion of the second core panel. The panel connector bar maintaining the core panels in a substantially co-planar relationship in a fastenerless fashion.

A second aspect of the present invention is a wall construction for subdividing building space. The wall comprises a demountable floor-to-ceiling central wall, and an overlay wall affixed to the demountable central wall. The demountable floor-to-ceiling central wall comprises a ceiling track shaped to capture an uppermost portion of the central wall and adapted for mounting to a building ceiling and a floor track shaped to capture a lowermost portion of the central wall and adapted for mounting to a building floor. The wall further includes a plurality of core panels, each of the panels including two parallel spaced-apart and substantially identical rectilinear side faces, in mutual horizontal registry. The side faces form a front and a rear exterior planar surface, and a panel periphery comprising a top edge, a bottom edge, and at least two side edges with an outwardly facing channel therein. The core panels are vertically oriented in a vertically and horizontally adjacent manner to form a generally co-planar wall wherein at least one core panel is positioned to be supported by the building floor. A plurality of panel connector bars are interposed between vertically adjacent ones of the core panels. A first portion of each panel connector bar is received by and engaged within the channel at a top portion of a lower of the vertically adjacent core panels, and a second portion of each panel connector bar is received by and engaged within the channel at a bottom portion of an upper of the core panels. The panel connector bars maintaining the core panels in a substantially co-planar relationship in a fastenerless fashion. A plurality of vertical studs each having two sides and extending from the floor to the ceiling are interposed between horizontally adjacent core panels. A first side of the vertical stud being adjacent to and in engagement with a side edge of at least one of the horizontally adjacent core panels and a second side of the vertical stud being adjacent to and in engagement with a side edge of a second of the horizontally adjacent core panels to maintain the horizontally adjacent core panels in a substantially aligned and co-planar relationship. The overlay wall is affixed to at least one of the exterior planar surfaces of the demountable central wall and comprises a plurality of horizontal structural supports each having flanges for mateably engaging the exterior planar surface of the side faces. The horizontal structural supports are accurately located at regularly spaced vertical intervals, each support includes a plurality of fasteners securing the horizontal structural supports to the central wall. A plurality of skins cover the horizontal supports and the wall construction. A plurality of connectors are configured to securely engage the skins and selected ones of the plurality of horizontal structural supports for releasably securing the skins to the horizontal structural supports.

Yet another aspect of the present invention is a demountable floor-to-ceiling wall for subdividing building space and the like. The wall comprises a floor track adapted for mounting to a building floor, and shaped to capture a lowermost portion of the wall. A ceiling track is adapted for mounting to a building ceiling and shaped to capture an uppermost portion of the wall. Each of a plurality of core panels has a one-piece construction with opposite exterior rigid sheets laterally spaced apart a predetermined distance and in horizontal registry. Each of the core panels also has a top edge, a bottom edge, and opposite side edges shaped for close reception in the ceiling track and in the floor track and further includes an inwardly protruding channel extending substantially continuously along each edge with a predetermined depth. Each of a plurality of panel connector bars having a width shaped for close reception in the channel of an associated core panel has a length which extends along at least a major portion of the core panel and has a height generally commensurate with the predetermined depth of two adjacent core panel channels. The panel connector bars securely interconnect the core panels in a vertically stacked, co-planar relationship between the floor track and the ceiling track in a substantially fastenerless fashion.

These and other objects, advantages and features of the present invention will become apparent upon review of the following specification in conjunction with the drawings.

BRIEF DESCRIPTION OF THE DRAWINGS

FIG. 1 is a perspective view of a portion of a building room in which a demountable wall according to the present invention is assembled to divide the building room into separate areas;

FIG. 2 is a plan view of a floor track portion of the demountable wall;

FIG. 3 is a cross-sectional view of the floor track, taken along the line III—III, FIG. 2;

FIG. 4 is a side elevational view of a ceiling track portion of the demountable wall;

FIG. 5 is a cross-sectional view of the ceiling track, taken along the line V—V, FIG. 4;

FIG. 6 is an elevational view of a wall panel member;

FIG. 7 is a fragmentary perspective view of a corner of the wall panel member showing the wall panel construction;

FIG. 8 is a plan view of a horizontal portion of a frame for the wall panels;

FIG. 9 is a cross-sectional view of the horizontal frame portion, taken along the line IX—IX, FIG. 8;

FIG. 10 is a side elevational view of the horizontal frame portion of FIG. 8;

FIG. 11 a fragmentary plan view of a vertical frame portion of the wall panel frame;

FIG. 12 is a cross-sectional view of the vertical frame portion, taken along the line XII—XII, FIG. 11;

FIG. 13 is an elevational view of horizontal connector bars and vertical studs used to stabilize adjoining wall panels;

FIG. 14 is a cross-sectional view of a connector bar, taken along the line XIV—XIV, FIG. 13;

FIG. 15 is an elevational view of a partially finished wall segment showing the demountable floor-to-ceiling wall according to the present invention and covered with aesthetically covered skins or cover panels to complete the wall;

FIG. 16 is an elevational section view of the finished wall of FIG. 15 showing a transparent transom incorporated into the wall and a lower wall portion with aesthetic skins attached to the wall taken along the line XVI—XVI, FIG. 15;

FIG. 17 illustrates the transparent transom construction similar to the wall panel construction and its interface with an open window frame and is an enlarged view of area XVII, FIG. 16;

FIG. 18 illustrates the open window frame interface with a wall panel and an aesthetic skin attached to one side of the wall panel and is an enlarged view of area XVIII, FIG. 16;

FIG. 19 is a perspective view of a spacer for installation between two vertically adjacent wall panels to maintain the wall panels in a vertically spaced apart relationship; and FIG. 20 is a perspective view of an adjustable foot for compensating for a uneven building floor upon which a floor track is mounted for supporting a wall according to the present invention and is an enlarged view of area XX, FIG. 16.

DETAILED DESCRIPTION OF THE PREFERRED EMBODIMENT

Figure 18A:
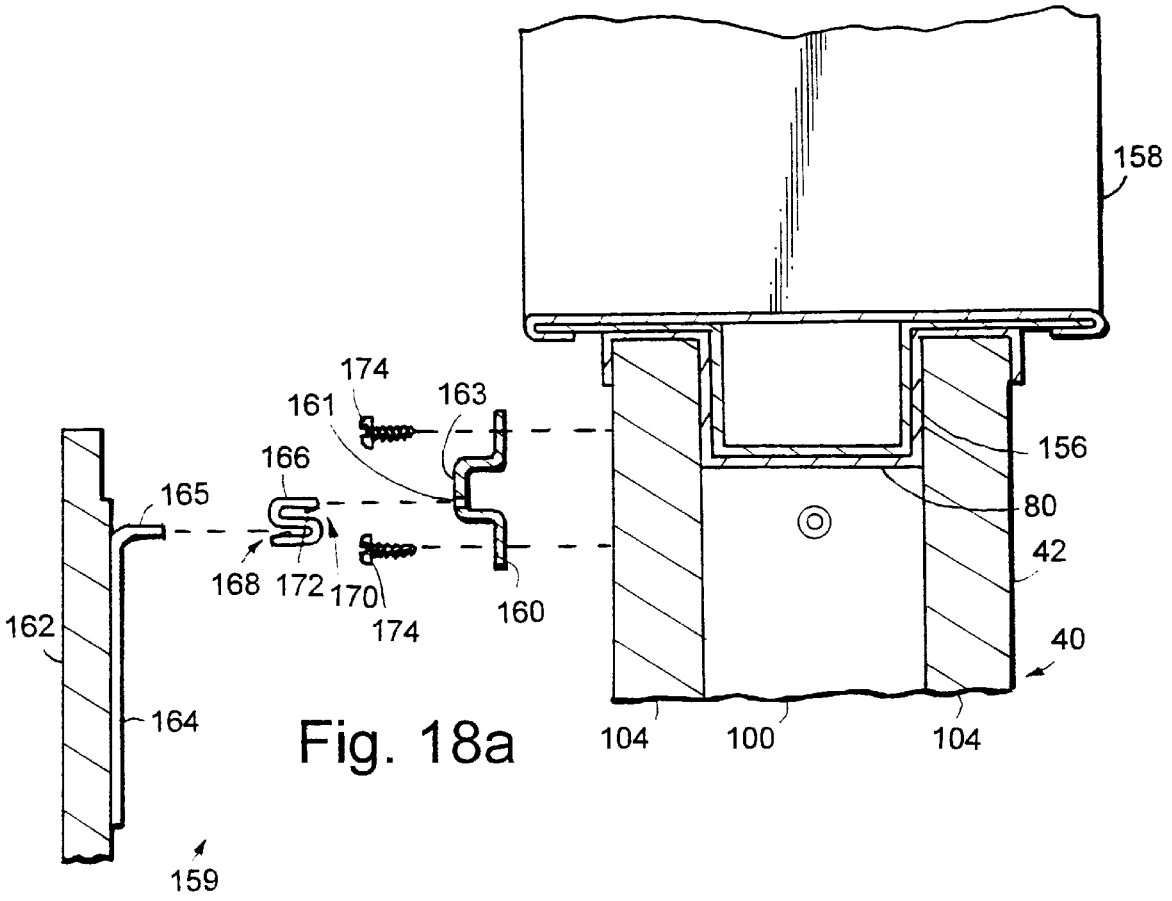
FIG. 18*a* is an enlarged exploded view of FIG. 18 showing the attachment of an overlay wall to the demountable wall of the present invention.

For purposes of description herein, the terms "upper," "lower," "right," "left," "rear," "front," "vertical," "horizontal," and derivatives thereof shall relate to the invention as oriented in FIGS. 1 and 6. However, it is to be understood that the invention may assume various alternative orientations and step sequences except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting unless the claims expressly state otherwise.

Turning to the drawings, FIG. 1 shows a demountable floor-to-ceiling wall system 40 according to the present invention installed in an open area of a building 30 wherein wall system 40 comprises a plurality of differently sized core panels 42 which are supported on a floor surface 32. Wall system 40, in addition to a plurality of core panels 42, is further comprised of a floor track 44, a ceiling track 46, and a plurality of vertical studs 48 and horizontal connector bars 50 interposed between adjacent core panels 42.

FIGS. 2–3 show one embodiment of floor track 44 comprising a bottom web 56 having inverted U-shape side members 58 at opposite edges thereof and forming a central channel 60. Central channel 60 is sized to closely receive core panels 42 therein, as described more fully below. Inverted U-shape members 58 also have an outer flange 62 extending laterally from a side opposite from web 56 and substantially parallel thereto. Flange 62 is generally vertically spaced slightly above the plane of web 56. Bottom web 56 of floor track 44 also has a plurality of regularly spaced holes 64 for anchoring track 44 to floor 32. Alternatively, bottom web 56 can have extensions (not shown) from a lower surface thereof which dig into floor 32 to retain track 44 in place on floor 32 without requiring floor mounted anchors. A plurality of regularly spaced, longitudinally extending elongated slots 66 are formed through web 56 to facilitate the routing of wiring and other office utilities through an interior portion of wall system 40.

FIGS. 4–5 show one example of ceiling track 46 comprising a web 70 typically having a plurality of regularly spaced holes and slots (not shown) similar to holes 64 and slots 66 of floor track 44 to anchor ceiling track 46 to ceiling 34 and to facilitate the routing of office utilities from ceiling 34 to an interior portion of wall system 40. Ceiling track 46 also comprises a plurality of regularly spaced legs 72 extending downwardly from web 70 thereby forming channel 74. Channel 74 is also sized to closely receive core panels 42 therein, as described more fully below.

Referring to FIGS. 6–7 each of the illustrated core panels 42 has a generally one-piece construction, which includes side faces 103 comprising exterior sheets 104 and generally U-shaped horizontal and vertical frame members 80 and 100 respectively extending around the periphery of panel 42. Frame members 80 and 100 are generally like-shaped, and like features of each are correspondingly like-numbered.

As shown in FIGS. 8–12, each of the frame members 80 and 100 has a web 82 wherein legs 84 extend downwardly therefrom forming an inverted U-shaped frame channel 86. Frame channel 86 is sized to closely receive therein horizontal connector bars 50 (FIG. 14) and vertical studs 48 (FIG. 1). Each of the downwardly depending legs 84 (FIGS. 8–12) has an upturned side flange 88 extending laterally away from frame channel 86. Legs 84 and flanges 88 form therebetween a panel receiving channel 87 whereby channel 87 is sized to closely receive therein a rigid panel or exterior sheet 104, such as gypsum board or the like. Each of frame members 80 and 100 has regularly spaced slots 92 extending through webs 82 for the routing of office utilities through an interior portion of panels 42, and has ends 98 which are typically mitered at 45 degree angles to facilitate assembly of panels 42. Horizontal frame member 80 additionally has a flange 94 (FIGS. 7, 9, and 10) extending upwardly from web 82 at substantially a right angle thereto and has a hole 96 extending through a central portion of flange 94. Vertical frame member 100 has a like-sized hole in web 82 positioned proximate to each end 98 to be in registration with hole 96 when mitered ends 98 of adjoining frame members 80 and 100 are placed at right angles with respect to each other.

The exterior sheets 104 (FIGS. 6 and 7) of core panel 42 are preferably constructed from a relatively rigid, dense material, such as gypsum board or the like. The exterior sheets 104 are separated from each other by one or more core pads 106 to provide lateral stability and additional rigidity to exterior sheets 104. In the preferred embodiment, four core pads 106 of honeycomb construction are positioned between exterior sheets 104 and are separated one from the other forming vertical and horizontal utility passageways 108 therebetween. Preferably, core panels 42 are provided in a wide variety of different heights and widths, the dimensions of each generally being a multiple of a nominal dimension. However, their thickness is substantially the same, and each has a similar modular construction, as outlined above.

The core panels 42 shown in FIGS. 6–10 are formed by capturing the edges of sheets 104 in panel receiving channels 87 of frame members 80 and 100 and by installing a fastener such as a blind rivet (not shown) through holes 96 and 102 of horizontal and vertical frame members 80 and 100 respectively. The assembled core panel 42 results in a rigid panel for use in the assembly of the demountable wall 40. Panels 42 may be constructed in any nominal size, however, in the preferred embodiment panels 42 are generally constructed in regular increments, such as six inch increments, to full size panels nominally four feet by eight feet to facilitate a wide range of desired wall heights and lengths. The thickness of the panels 42 can also be of any desired thickness and is controlled by the dimensions of frame members 80 and 100. In the preferred embodiment, core panels 42 and the resulting wall system 40 is typically of a nominal two inch thickness to permit the addition of optional aesthetic panels and skins to the exterior of wall 40 such as described more fully below.

With reference to FIGS. 13–14, horizontal connector bars 50 are provided in different lengths, each connector bar 50 having a substantially identical vertical cross-sectional configuration, comprising a rectangular central core 114 with a pair of T-shaped flanges 118 extending outwardly from opposite core sides 116 of core 114. T-shaped flanges 118 combine with core sides 116 to form connector bar channels 120. Central rectangular core 114 of connector bar 50 is designed to be received closely within U-shaped frame channels 86 of an associated core panel 42, and connector bar channels 120 are designed to closely receive upturned side flanges 88 of core panels 42 so as to securely vertically stack core panels 42. In the preferred embodiment, connector bar 50 is comprised of two connector bar halves 110. Each connector bar half 110 has a cross-sectional configuration similar to the cross-sectional configuration of frame members 80 and 100. To form the illustrated connector bar 50, two halves 110 are abutted in a back-to-back manner and affixed one to the other such as by spot welding, gluing or by some other similar manner. Connector bar 50 also has a plurality of slots (not shown), similar to and generally corresponding to the position of slots 92 in frame members 80 and 100, through rectangular core 114 to permit the routing of electrical and similar office utilities therethrough from one core panel 42 to an adjacent panel 42.

Vertical studs 48 (FIG. 1) are identical in cross-sectional configuration and construction as horizontal connector bars 50, having a central rectangular core and T-shaped flanges extending outwardly therefrom. The length of vertical studs 48 generally are such as to extend between floor and ceiling tracks 44 and 46 affixed to the building floor 32 and ceiling 34. Optionally, vertical studs 48 can also be configured with an I-shape cross section (not shown).

As discussed above, slots 92 in frame members 80 and 100 can be provided for the routing of office utilities, such as power lines, data cords, etc., therethrough. In such an application, horizontal connector bars 50 and vertical studs 48 will have correspondingly positioned apertures for the routing of utilities between vertically adjacent and horizontally adjacent panels 42. In the alternative, each of panels 42, connector bars 50, and studs 48 can include a utility distribution member positioned at the apertures such that adjacent utility distribution members interconnect one with the other to form a continuous utility distribution chain throughout the demountable wall. Those skilled in the art will appreciate the facilitation of such is accomplished through the use of alternating male and female connections and the uniform placement of such connections at nominally common intervals along the edges of the panels 42, connector bars 50, and studs 48.

Spacer 52, as shown in FIG. 19, is comprised of a tube 126 having plates 128 affixed at each end thereof. Tubes 128 can be of a variety of lengths to provide a variety of spaces from which a user may choose when installing wall system 40. Plates 128 are generally elongated and rectangular with the narrow dimension being slight smaller than the width of frame channel 86 to enable frame channel 86 to receive plates 128 therein. Each plate 128 has a centrally located hole 129 through which tube 126 is received. Plates 128 are affixed to tube 126 such that an end portion 130 of tube 126 projects through plate 128 and such that the longitudinal axes of plates 128 are substantially parallel.

In operation, and referring to FIG. 1, ceiling track 46 is first attached to a structural support in ceiling 34 along the line the demountable wall 40 is desired to be constructed. Floor track 44 is then positioned directly under ceiling track 46 and anchored to the floor 32. Bottom web 56 of floor track 44 can alternatively have extensions which dig into the floor 32 to retain track 44 in place without requiring floor mounted anchors. A first vertical stud 48 is first assembled in place between ceiling track 46 and floor track 44 and positioned in a substantially vertical orientation. At the option of the user, those vertical studs 48 positioned adjacent the existing architecture of the building may be anchored to the building wall. Core panels 42 are then stacked vertically in place on floor track 44, engaging their associated side edges in the side channel 86 of vertical stud 48. Horizontal connector bars 50 are positioned between each core panel 42, so as to interlock panels 42 in a substantially co-planar relationship. Once a first column of core panels 42 is in place, a second vertical stud 48 is positioned along the opposite edges of the core panels 42 so as to capture core panels 42 between the opposite vertical studs 48. Adjacent columns of core panels 42 are then vertically stacked and similarly secured with vertical studs 48 for the length of the desired demountable wall 40.

Core panels 42, horizontal connector bars 50, and vertical studs 48 interconnect in such a manner as to preclude the necessity of using separate fasteners. Horizontal connector bars 50 securely capture and retain adjacent horizontal edges of vertically adjacent core panels 42 to maintain panels 42 in a substantially co-planar relationship. Likewise, vertical studs 48 capture and retain adjacent vertical edges of adjacent columns of panels 42 to retain panels in a substantially co-planar relationship. Those skilled in the art will appreciate that a wall can thus be formed in first a vertically sequential and then horizontally sequential manner without separate fasteners being used to interconnect panels 42, connector bars 50, and studs 48 one to the other or to interconnect same with ceiling track 46 and floor track 44.

As shown in FIG. 1, spacers 52 can also be positioned between vertically adjacent core panels 42 to form a pass-through or window. Two spacers 52 of a length corresponding to the height dimension of the desired pass-through are selected and place in the top channel 86 of an installed panel 42. Ends 130 of tubes 126 are inserted in slots 92 of frame members 80 and 100 such that plates 128 of spacer 52 bear against web 82 of the frame. Another panel 42 is placed on the spacers 52 such that the tops of spacers 52 engage the lower channel 86 of the added panel 42. The remainder of the desired wall may then be completed with either panels 42 or spacers 52 to form additional window.

Quite often, the plane of ceiling 34 and floor 32 are not perfectly parallel thereby requiring vertical adjustment of wall 40 to facilitate a properly installed wall. Such vertical adjustment is provided with a threaded rod 136 (FIG. 20) supported by support block 138 a lower portion of the ends of a bottom core panel 42. A glide 134 is affixed to the bottom end of threaded rod 136 and is laterally retained by channel 60 in floor track 44. Threaded rod 136 at each end of core panel 42 is vertically adjusted to support bottom panel 42 in a substantially horizontal orientation prior to stacking additional panels 42 thereupon. The bottom portion of wall 40 can be concealed with a kick panel 176 (FIG. 15) in a manner consistent with the prior art.

Referring now to FIGS. 15–18, a finished partition according to the present invention is shown including a transparent panel 152, a pass-through teller-like window formed by frame 158 and aesthetic skins 162 affixed to wall system 40. A wall core is constructed as per the present invention, although instead of using spacers 52 to create a window, a window frame 158 having a tongue 156 therearound is placed on supporting panels 42 such that tongue 156 engages channel 86 in panels 42. Additional panels 42 are abutted against window frame 158 and also received the frame tongue in their respective channels 86. The window frame is typically thicker than the two inch panel 42 in order to facilitate the addition of aesthetic skins 162 thereby forming a uniform surface presented to the user. In the preferred embodiment window frame 158 is constructed of a nominal six inch thickness to accommodate the two inch wall 40 and aesthetic skins applied to both sides of wall 40.

As illustrated in FIGS. 15–17, transparent panel 152 is constructed in a manner similar to panels 42. Panel 152 has exterior transparent panels such as glass, Plexiglas, or other transparent material captured by a frame therearound to form panel 152. Panel 152 also has a central channel therearound similar to frame channel 86 to receive vertical studs 48 and horizontal connector bars 50 thereby facilitating construction of the wall 40.

As shown in FIGS. 18 and 18*a*, an overlay wall 159 of aesthetic skins 162 can be affixed over the exterior surface of demountable wall 40. Although a variety of skin configurations and attachment systems can be utilized in conjunction with wall 40, in the preferred embodiment of overlay wall 159, a plurality of horizontal supports 160 of generally hat-shaped cross section are affixed to wall 40 at regularly accurately spaced vertical intervals using fasteners 174. Horizontal supports 160 have a plurality of regularly spaced horizontal slots 161 through raised surface 163 and proximate to hat wall 167. The vertical intervals at which horizontal supports 162 are spaced generally correspond to the specific attachment requirements of skins 162.

Skins 162 can be constructed of metal and can have a fabric or painted facing or may be constructed of gypsum board or other like material to provide additional fire protection and acoustic insulation to the wall construction. Skins 162 typically have an L-bracket 164 attached to a rear surface of the skin with one leg 165 of the 'L' projecting rearward from skin 162 in a horizontal plane. Skin 162 is attached to the horizontal support 160 by 'S' clip connectors 166. One loop of 'S' clip connector 166 forms slot 170 which engages wall 167 of horizontal support 162 at selected ones of regularly spaced apertures 161 therein and the other loop of 'S' clip connector 166 forms slot 168 which engages leg 165 of L-bracket 164 thereby securing skin 162 to wall 40. 'S' clip connector 166 can also incorporate barbs 172 which protrude into slots 168 and 170 to provide additional retentive force to maintain skins 162 in their desired relationship with wall 40.

In the foregoing description, it will be readily appreciated by those skilled in the art that modifications may be made to the invention without departing from the concepts disclosed herein. Such modifications are to be considered as included in the following claims, unless these claims expressly state otherwise.

The embodiments of the invention in which an exclusive property or privilege is claimed are defined as follows:

1. In a demountable floor-to-ceiling wall for subdividing building work space of the type having a floor and a ceiling, the improvement comprising:

a first core panel including two parallel spaced-apart and substantially identical side faces in mutual horizontal registry, and a panel periphery comprising a top edge, a bottom edge, and at least two side edges, with an outwardly facing channel therein, said first core panel being vertically oriented and positioned to be supported by the building floor;

a second core panel of substantially identical construction as said first core panel and vertically stacked upon and substantially co-planar with said first core panel, said first and second core panels extending from the floor toward the ceiling and secured in a generally upright vertical orientation; and a horizontal panel connector bar having a rectilinear core with upper and lower portions separated by laterally outwardly extending T-flanges at opposite sides of said core, said T-flanges in combination with said core defining oppositely oriented connector bar channels at said opposite sides, said connector bar interposed between said first and said second core panels, said lower portion of said panel connector bar received in a non-locking lay-in fashion by said channel at a top portion of said first core panel and said upper portion of said panel connector bar received in a non-locking lay-in fashion by said channel at a bottom portion of said second core panel, said panel connector bar maintaining said core panels in said substantially co-planar relationship in a fastenerless fashion.

2. The demountable floor-to-ceiling wall as set forth in claim 1, wherein at least one of said core panels further includes a frame therearound, said frame defining said outwardly facing channel, said frame formed to capture edges of said side faces for maintaining said side faces in said spaced apart mutual horizontal registry.

3. The demountable floor-to-ceiling wall as set forth in claim 2, wherein at least one of said core panels further includes a core member disposed between said side faces for maintaining a central portion of said side faces in said spaced apart relationship.

4. The demountable floor-to-ceiling wall as set forth in claim 3, wherein said core member comprises a plurality of core members, said plurality of core members arranged to define at least one horizontal and at least one vertical utility passageway within an interior of said at least one core panel.

5. The demountable floor-to-ceiling wall as set forth in claim 4, wherein said frame further includes a web at a bottom of said channel, said web having a plurality of apertures therethrough, said apertures substantially aligned with said horizontal and vertical utility passageways for routing office utilities through said interior of said core panel.

6. The demountable floor-to-ceiling wall as set forth in claim 5, wherein said connector bar has a plurality of like apertures therethrough in registry with said apertures in said web and further wherein at least one of said panels further includes a utility distribution member extending between two of said apertures for distributing office utilities through said panel.

7. The demountable floor-to-ceiling wall of claim 6, wherein each of said panels and said connector bar includes a utility distribution member extending between corresponding ones of said apertures and further wherein adjacent ones of said utility distribution members interconnect to form a continuous utility distribution chain through said wall.

8. The demountable floor-to-ceiling wall as set forth in claim 7, wherein said first core panel includes at least one glide along a bottom edge thereof to be supported by the building floor.

9. The demountable floor-to-ceiling wall as set forth in claim 8, wherein said glide is vertically adjustable to vertically adjust said wall.

10. The demountable floor-to-ceiling wall of claim 1, wherein said connector bar comprises two U-shaped connector bar halves having two legs maintained in a parallel spaced apart relationship by a lower web therebetween and further having outwardly extending flanges at free ends of said legs of said U-shape and downwardly turned lips at free ends of said flanges, said lips and said legs forming therebetween said connector bar channels and further wherein said connector bar halves are fastened in a back-to-back fashion to form said panel connector bar.

11. The demountable floor-to-ceiling wall as set forth in claim 1, wherein said side faces are at least partially constructed of gypsum board.

12. The demountable floor-to-ceiling wall as set forth in claim 1 further comprising a generally U-shaped ceiling track affixed to the building ceiling, said U-shape downwardly oriented from the ceiling and shaped to receive an upper edge of said second core panel for supporting said second core panel in a substantially vertical co-planar orientation with said first core panel.

13. The demountable floor-to-ceiling wall of claim 12 further comprising a generally U-shaped floor track anchored to the building floor and vertically aligned with said ceiling track, said floor track U-shape upwardly oriented and shaped to receive a glide affixed to said bottom edge of said first core panel.

14. The demountable floor-to-ceiling wall of claim 13 further comprising a vertical stud having two sides and extending from said floor track to said ceiling track, a first side of said vertical stud being adjacent to and in engagement with a side edge of said first and said second core panels to maintain said first and said second core panels in a vertically aligned substantially co-planar relationship.

15. The demountable floor-to-ceiling wall as set forth in claim 14, wherein said vertical stud has a generally rectilinear core having two side portions, each of said side portions shaped to be closely received by said channel in said core panels and further wherein said side portions of said vertical stud are separated one from the other by a longitudinal flange extending laterally from opposite sides of said panel connector bar, said longitudinal flange being a T-flange forming oppositely oriented stud channels at each of said opposite sides of said vertical stud shaped to receive edges of said side faces of said core panel.

16. The demountable floor-to-ceiling wall as set forth in claim 14, wherein said vertical stud comprises a vertical I-beam having back-to-back vertical channels, each of said vertical channels corresponding to said first and second sides of said vertical stud and further wherein said channels are sized to closely receive said side edges of said core panels.

17. The demountable floor-to-ceiling wall as set forth in claim 14 further comprising at least a third core panel, said at least third core panel being substantially identical to said first and said second core panels and having a bottom edge, a top edge and side edges wherein said bottom edge of said at least third core panel is supported by said floor track and one of said side edges is adjacent to and engaged with said second side of said vertical stud to maintain said first, second, and third core panels in a substantially rigid vertical co-planar relationship.

18. The demountable floor-to-ceiling wall as set forth in claim 14, wherein each of said core panels includes a frame therearound, said frame defining said outwardly facing channel and further wherein each of said frames has a plurality of regularly spaced apertures therethrough at a bottom portion of said channel and further wherein said connector bars and vertical studs have a plurality of regularly spaced apertures therethrough substantially in registration with said regularly spaced apertures in said core panel frames and adapted to route office utilities therethrough.

19. The demountable floor-to-ceiling wall of claim 18 comprising a plurality of said core panels; a plurality of said horizontal connector bars; and a plurality of said vertical studs forming a substantially rigid co-planar wall of a desired length.

20. The demountable floor-to-ceiling wall of claim 19, wherein each of at least a portion of said panels, said connector bars, and said studs includes a utility distribution member extending between corresponding ones of said apertures and further wherein adjacent ones of said utility distribution members interconnect to form a continuous utility distribution chain through said wall.

21. The demountable floor-to-ceiling wall of claim 20, wherein said core panels, said horizontal connector bars, and said vertical studs form said rigid co-planar wall without fasteners connecting adjacent ones of said panels, connector bars, or studs one to the other.

22. The demountable floor-to-ceiling wall of claim 19, wherein said plurality of core panels comprises differently sized core panels, the dimensions of each of said differently sized core panels being a multiple of a nominal minimum dimension.

23. The demountable floor-to-ceiling wall of claim 22, wherein at least one of said plurality of core panels is replaced by at least one vertical spacer, said vertical spacer comprising a vertical support tube having support plates affixed proximate each end of said vertical support tube, said support plates being substantially parallel and at least a portion of each end of said support tube protruding through a corresponding said support plate such that said support plates are received within said channel of said core panel frame and each of said protruding portions of said vertical support tube extend through one of said apertures in said core panel frame.

24. A wall construction for subdividing building space, comprising:

a demountable floor-to-ceiling central wall, said demountable central wall further comprising:

a ceiling track shaped to capture an uppermost portion of said central wall therein and adapted for mounting to a building ceiling;

a floor track shaped to capture a lowermost portion of said central wall therein and adapted for mounting to a building floor;

a plurality of core panels, each of said panels including two parallel spaced-apart and substantially identical side faces in mutual horizontal registry forming a front and a rear exterior planar surface, and a panel periphery comprising a top edge, a bottom edge, and at least two side edges, with an outwardly facing channel therein, said core panels being vertically oriented in a vertically and horizontally adjacent manner and at least one of said core panels is positioned to be supported by the building floor;

a plurality of horizontal panel connector bars, each said connector bar having a rectilinear core with upper and lower portions separated by laterally outwardly extending T-flanges at opposite sides of said core, said T-flanges in combination with said core defining oppositely oriented connector bar channels at said opposite sides, each said connector bar interposed between vertically adjacent ones of said core panels, said lower portion of each said panel connector bar received in a non-locking lay-in fashion by said channel at a top portion of a lower of said vertically adjacent ones of said core panels and said upper portion of each said panel connector bar received in a non-locking lay-in fashion by said channel at a bottom portion of an upper of said core panels, said panel connector bars maintaining said core panels in said substantially co-planar relationship in a fastenerless fashion;

a plurality of vertical studs, each of said studs having two sides and extending from the floor to the ceiling and interposed between horizontally adjacent of said core panels, a first side of said vertical stud being adjacent to and in non-locking connection with a side edge of at least one of said horizontally adjacent core panels and a second side of said vertical stud being adjacent to and in a non-locking connection with a side edge of a second of said horizontally adjacent core panels to maintain said horizontally adjacent core panels in a substantially aligned and co-planar relationship; and an overlay wall affixed to at least one of said exterior planar surfaces of said demountable central wall, said overlay wall further comprising:

a plurality of horizontal structural supports each having flanges for mateably engaging said exterior planar surface of said side faces, said horizontal structural supports accurately located at regularly spaced vertical intervals, each including a plurality of fasteners securing said horizontal structural supports to said central wall;

a plurality of skins for covering said wall construction; and a plurality of connectors configured to securely engage said skins and selected ones of said plurality of horizontal structural supports for releasably securing said skins to said horizontal structural supports.

25. The wall construction of claim 24, wherein said core panels, said horizontal connector bars, and said vertical studs form said rigid co-planar wall without fasteners connecting adjacent ones of said panels, connector bars, or studs one to the other.

26. The wall construction of claim 25, wherein said side faces include gypsum material.

27. The wall construction of claim 25, wherein at least two of said horizontal structural supports are attached to each of said front planar surface and said rear planar surface.

28. The wall construction of claim 25, wherein said horizontal structural supports are hat shaped in cross section.

29. The wall construction of claim 28, wherein said horizontal structural supports include a horizontal row of slots adapted to receive attachment connectors.

30. The wall construction of claim 29 further including attachment connectors for mateably engaging selected ones of said horizontal row of slots and for mateably engaging said skins for retaining said skins in a fixed relationship with said horizontal supports.

31. A demountable floor-to-ceiling wall for subdividing building space, comprising:

a floor track adapted for mounting to a building floor and shaped to capture a lowermost portion of said wall therein;

a ceiling track adapted for mounting to a building ceiling, and shaped to capture an uppermost portion of said wall therein;

a plurality of core panels, each having a one-piece construction with opposite exterior rigid sheets which are spaced laterally apart a predetermined distance in horizontal registry; each of said core panels having a top edge, a bottom edge, and opposite side edges shaped for close reception in said ceiling track and said floor track, and including an inwardly protruding channel extending substantially continuously therealong with a predetermined depth; and a plurality of horizontal panel connector bars, each having a width shaped for close reception in a non-locking lay-in fashion in the channel of an associated one of said core panels, a length which extends along at least a major portion thereof, and a height generally commensurate with said predetermined depth of two adjacent core panel channels and further including laterally outwardly extending T-flanges at opposite sides of said bar, said T-flanges defining a portion of oppositely oriented connector bar channels at opposite sides of said connector bar, whereby said panel connector bars maintain said core panels in a vertically stacked, co-planar relationship between said floor track and said ceiling track in a substantially fastenerless fashion.

32. A demountable floor-to-ceiling wall according to claim 31, wherein at least one of said core panels further includes a frame therearound, said frame defining said inwardly protruding channel.

33. A demountable floor-to-ceiling wall according to claim 32, wherein at least one of said core panels further includes a core member disposed between said opposite exterior rigid sheets for maintaining said sheets in said laterally spaced apart horizontal registry.

34. A demountable floor-to-ceiling wall according to claim 33, wherein said core member comprises a plurality of core members, said plurality of core members defining at least one horizontal passageway and at least one vertical passageway within an interior of said core panel.

35. A demountable floor-to-ceiling wall according to claim 34, wherein said frame includes a web defining a bottom of said channel, said web having a plurality of apertures therethrough, each of said apertures substantially aligned with said at least one horizontal and said at least one vertical passageway for routing office utilities through said interior of said core panel.

36. A demountable floor-to-ceiling wall according to claim 35, wherein each of said connector bars has a plurality of like apertures therethrough in registry with said apertures in said web.

37. A demountable floor-to-ceiling wall according to claim 31, further comprising a plurality of vertical studs, each generally extending from floor to ceiling and having a width shaped for close reception of horizontally adjacent ones of said core panels whereby said vertical studs securely interconnect horizontally adjacent ones of said vertically stacked core panels in a horizontally extending co-planar relationship between said floor track and said ceiling track in a substantially fastenerless fashion.

38. A demountable floor-to-ceiling wall according to claim 37, wherein each of said vertical studs has a plurality of like apertures therethrough in registry with said apertures in said web.

39. A demountable floor-to-ceiling wall according to claim 38, wherein said core panels, said connector bars, and said vertical studs form said rigid co-planar wall without fasteners connecting adjacent ones of said panels, connector bars, or studs one to the other.

40. A demountable floor-to-ceiling wall according to claim 39, wherein said plurality of core panels comprises differently sized core panels, the dimensions of each of said differently sized core panels being a multiple of a nominal minimum dimension.

41. A demountable floor-to-ceiling wall according to claim 40, wherein at least one of said plurality of core panels is replaced by at least one vertical spacer, said vertical spacer comprising a vertical support interposed between an upper and a lower ones of said core panels maintaining said upper and said lower ones of said panels in a vertically spaced apart relationship wherein said upper and said lower ones of said panels define at least a portion of a void area of said wall.

42. A demountable floor-to-ceiling wall according to claim 41, further comprising a plurality of utility distribution members interconnected to form a utility distribution chain disposed within and extending through said apertures and said vertical and said horizontal passageways for the delivery of office utilities to selected portions of said wall.

* * * * *

UNITED STATES PATENT AND TRADEMARK OFFICE

CERTIFICATE OF CORRECTION

PATENT NO. : 5,992,109
DATED : November 30, 1999
INVENTOR(S) : Kurt A. Jonker

It is certified that error appears in the above-identified patent and that said Letters Patent is hereby corrected as shown below:

Column 2, line 36;
"maintaining" should be --maintains--.

Column 4, line 40;
"a" should be --an--.

Column 7, line 19;
"slight" should be --slightly--.

Column 8, line 1;
"place" should be --placed--.

Column 8, line 9;
"plane" should be --planes--.

UNITED STATES PATENT AND TRADEMARK OFFICE

CERTIFICATE OF CORRECTION

PATENT NO. : 5,992,109
DATED : November 30, 1999
INVENTOR(S) : Kurt A. Jonker

It is certified that error appears in the above-identified patent and that said Letters Patent is hereby corrected as shown below:

Column 8, line 32;
"received" should be --receive--.

Column 14, claim 37, line 15;
"31" should be --36--.

Signed and Sealed this

Twenty-first Day of November, 2000

*Attest:*

Q. TODD DICKINSON

*Attesting Officer*

*Director of Patents and Trademarks*